US010697141B1

(12) United States Patent
Hillis

(10) Patent No.: US 10,697,141 B1
(45) Date of Patent: Jun. 30, 2020

(54) PORTABLE VIEW BARRIER SYSTEM

(71) Applicant: Logan Hillis, Houston, TX (US)

(72) Inventor: Logan Hillis, Houston, TX (US)

( * ) Notice: Subject to any disclaimer, the term of this patent is extended or adjusted under 35 U.S.C. 154(b) by 0 days.

(21) Appl. No.: 16/292,471

(22) Filed: Mar. 5, 2019

(51) Int. Cl.

| | |
|---|---|
| ***E01F 15/10*** | (2006.01) |
| ***E01F 15/08*** | (2006.01) |
| ***E01F 8/00*** | (2006.01) |
| ***E01F 15/12*** | (2006.01) |
| *E01F 7/06* | (2006.01) |
| *E01F 9/669* | (2016.01) |
| *E04H 17/06* | (2006.01) |

(52) U.S. Cl.
CPC ..... *E01F 15/10* (2013.01); *E01F 8/0041* (2013.01); *E01F 15/085* (2013.01); *E01F 15/12* (2013.01); *E01F 7/06* (2013.01); *E01F 9/669* (2016.02); *E04H 17/06* (2013.01)

(58) Field of Classification Search
CPC . E01F 7/06; E01F 8/0041; E01F 9/669; E01F 15/085; E01F 15/10; E01F 15/12; E04H 17/06
USPC ..... 404/6, 9; 256/13.1; 40/612
See application file for complete search history.

(56) References Cited

U.S. PATENT DOCUMENTS

| | | | | |
|---|---|---|---|---|
| 4,124,196 | A | 11/1978 | Hipskind | |
| 4,134,439 | A | 1/1979 | Scott | |
| 4,186,912 | A | 2/1980 | Byrd | |
| 4,533,122 | A | 8/1985 | Bannister | |
| 5,054,507 | A * | 10/1991 | Sparks | E04H 15/003 135/149 |
| 5,269,623 | A | 12/1993 | Hanson | |
| 5,595,230 | A | 1/1997 | Guerra | |
| 6,036,249 | A | 3/2000 | Kuntz | |
| D486,529 | S | 2/2004 | Valenzuela | |
| 6,733,204 | B1 | 5/2004 | Paniccia | |
| 7,109,885 | B1 * | 9/2006 | Denlinger | E01F 7/00 116/63 P |
| 7,290,826 | B2 * | 11/2007 | Dempsey | B60J 11/00 150/166 |
| 7,600,554 | B1 | 10/2009 | Wright | |
| 8,973,645 | B1 * | 3/2015 | Cannova | E01F 7/00 160/351 |
| 2007/0166101 | A1 * | 7/2007 | Scheu | B60J 11/00 404/6 |
| 2017/0370120 | A1 * | 12/2017 | Billings | E04H 17/168 |

* cited by examiner

*Primary Examiner* — Raymond W Addie
(74) *Attorney, Agent, or Firm* — Kyle A. Fletcher, Esq.

(57) ABSTRACT

The portable view barrier system is a privacy screen. The portable view barrier system is adapted for use with emergency service personnel. The portable view barrier system is adapted to protect the privacy of a patient from the view of traffic during an unfortunate event. The portable view barrier system comprises a plurality of mesh panels, one or more living hinges, and a plurality of weighted anchors. Each of the plurality of mesh panels is a screen the blocks the view of the unfortunate event from passing traffic. The one or more living hinges attaches an initial mesh panel selected from the plurality of mesh panels to a subsequent panel selected from the plurality of mesh panels. The plurality of weighted anchors form anchor points that anchor the interconnected plurality of mesh panels to the ground. The portable view barrier system is a collapsible structure stored within an emergency response vehicle.

19 Claims, 5 Drawing Sheets

PORTABLE VIEW BARRIER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation and signaling including signaling devices for emergency vehicles. (B60Q7/00)

SUMMARY OF INVENTION

The portable view barrier system is a privacy screen. The portable view barrier system is adapted for use with emergency service personnel. The portable view barrier system is adapted to protect the privacy of a patient from the view of traffic during an unfortunate event. The portable view barrier system comprises a plurality of mesh panels, one or more living hinges, and a plurality of weighted anchors. Each of the plurality of mesh panels is a screen the blocks the view of the unfortunate event from passing traffic. The one or more living hinges attaches an initial mesh panel selected from the plurality of mesh panels to a subsequent panel selected from the plurality of mesh panels. The plurality of weighted anchors form anchor points that anchor the interconnected plurality of mesh panels to the ground. The portable view barrier system collapses into a stack for storage within an emergency response vehicle.

These together with additional objects, features and advantages of the portable view barrier system will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable view barrier system in detail, it is to be understood that the portable view barrier system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable view barrier system.

It is therefore important that the claims be regarded as including such equivalent construction insofar as they do not depart from the spirit and scope of the portable view barrier system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
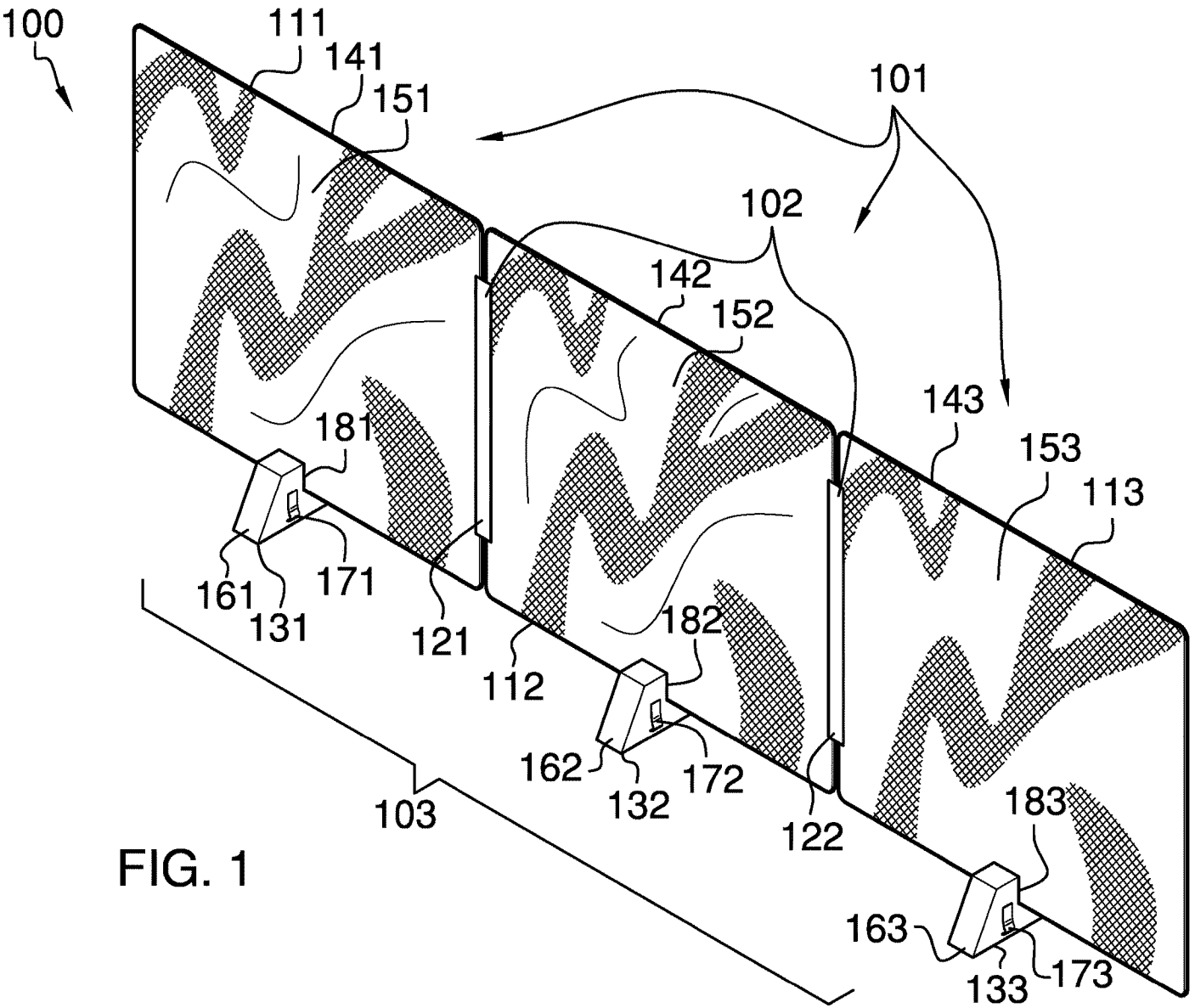
FIG. 1 is a perspective view of an embodiment of the disclosure.
Figure 2:
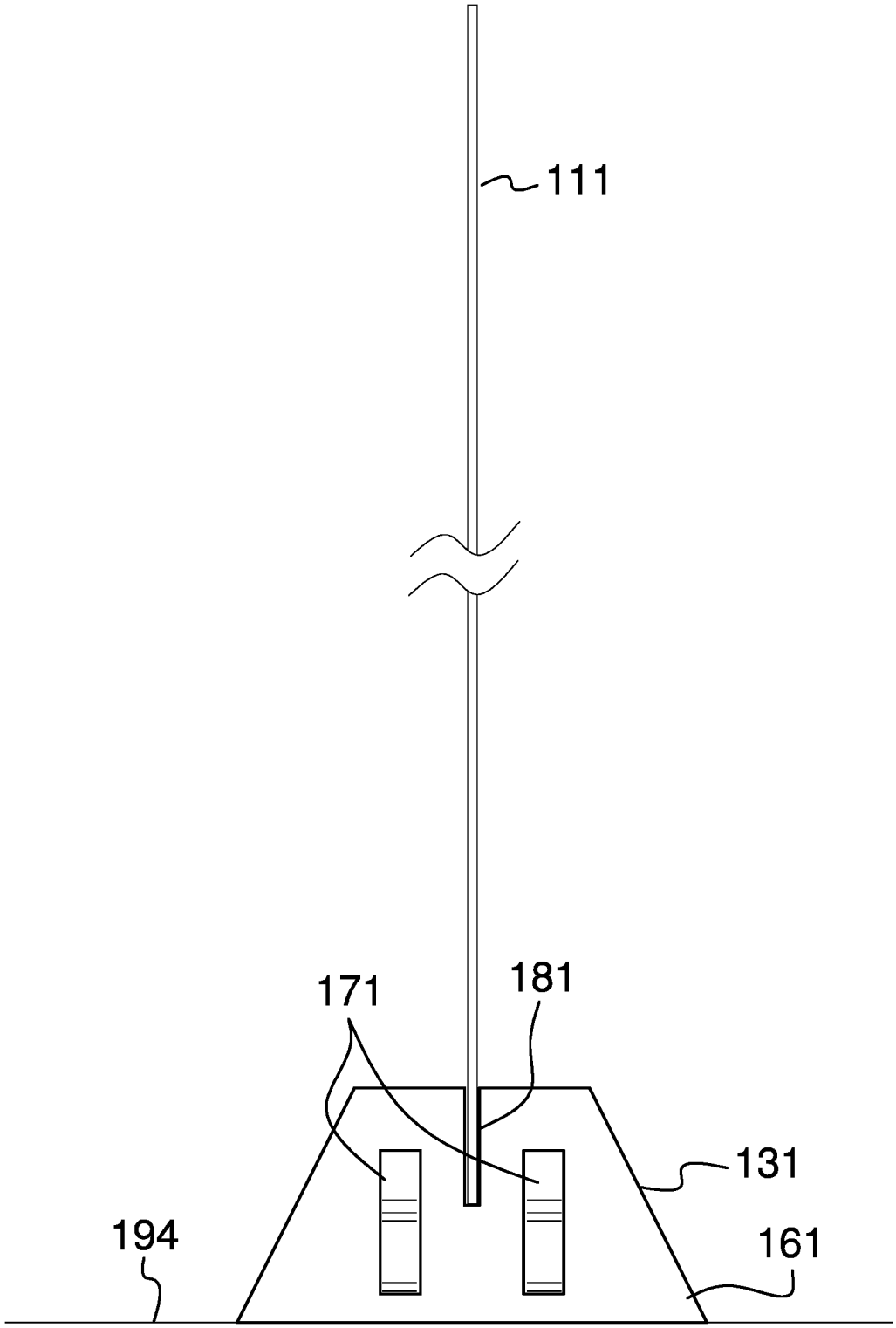
FIG. 2 is a side view of an embodiment of the disclosure.
Figure 3:
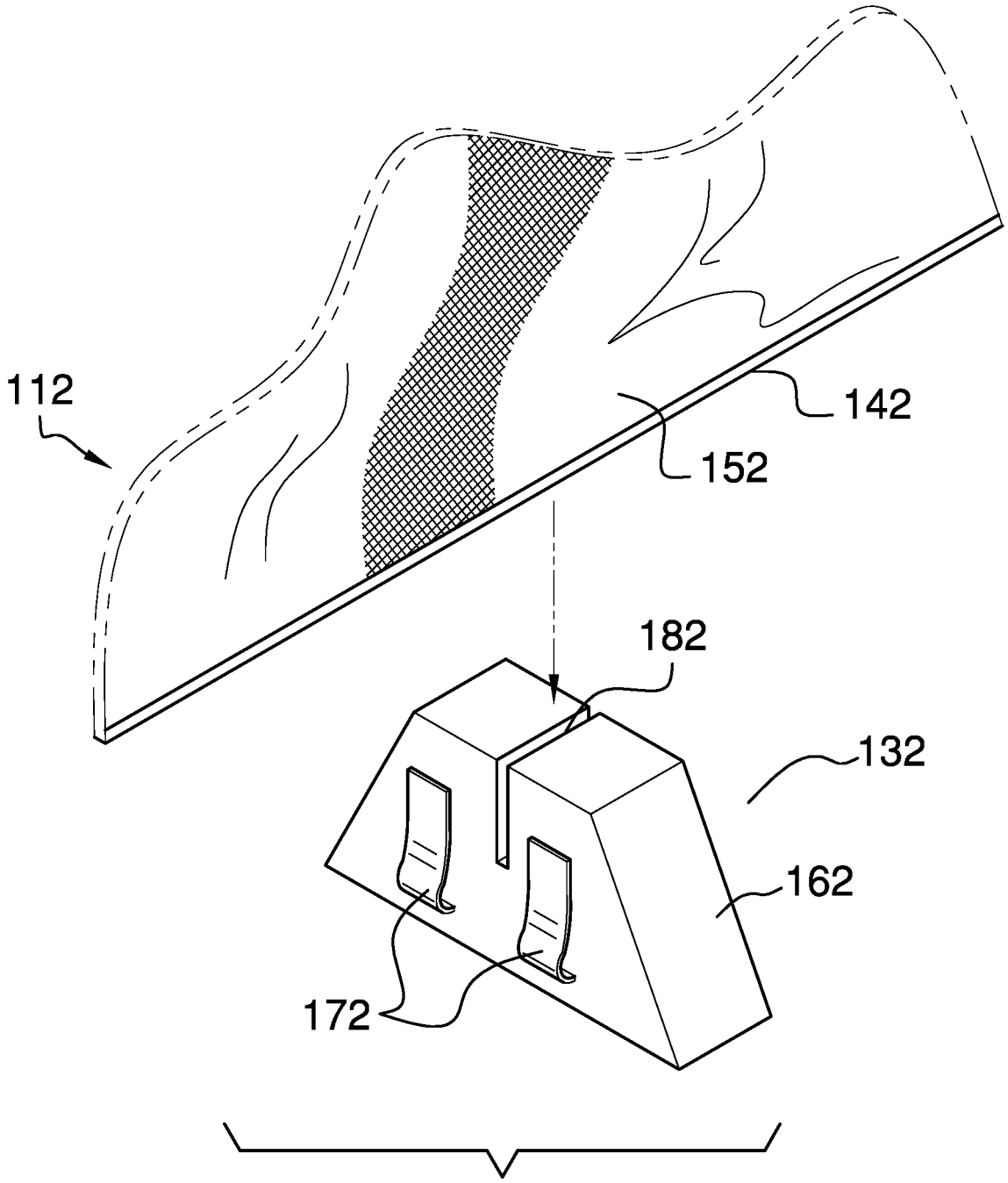
FIG. 3 is an exploded view of an embodiment of the disclosure.
Figure 4:
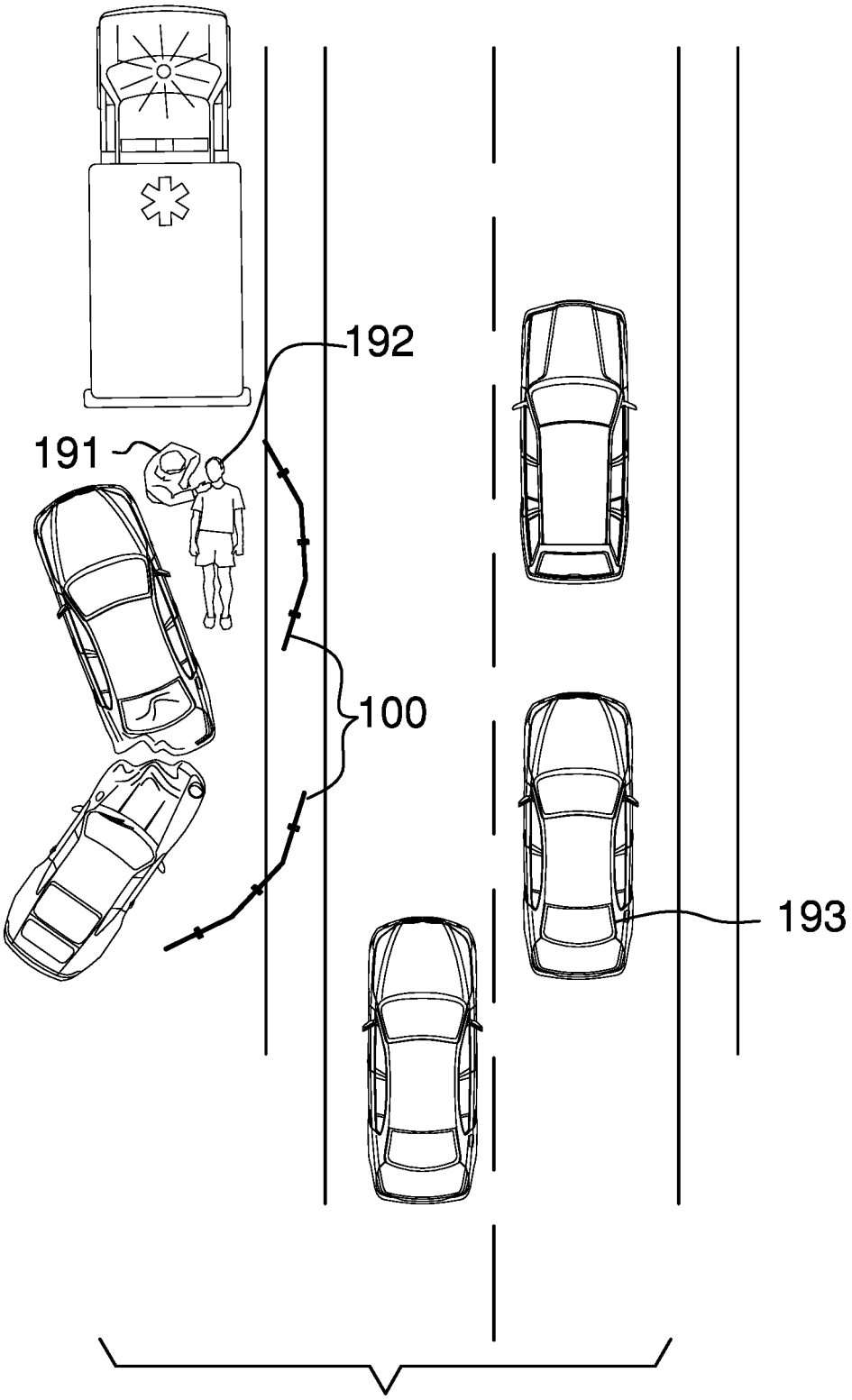
FIG. 4 is an in-use view of an embodiment of the disclosure.
Figure 5:
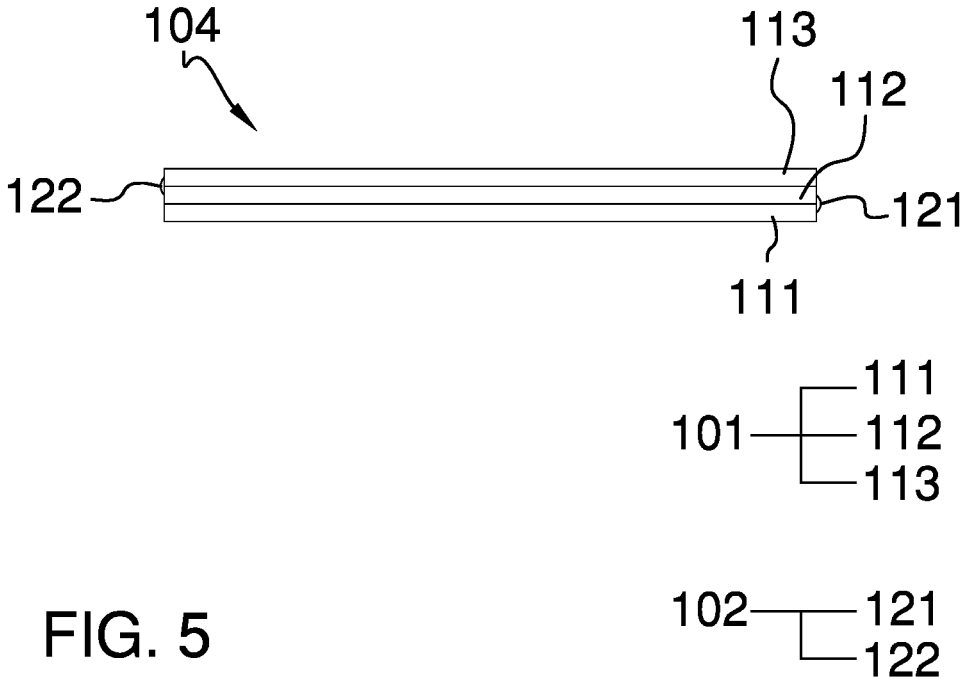
FIG. 5 is a detail view of an embodiment of the disclosure.

Detailed reference will now be made to one or more potential embodiments of the disclosure, which are illustrated in FIGS. 1 through 5.

The portable view barrier system 100 (hereinafter invention) is a privacy screen. The invention 100 is adapted for use with emergency service personnel 191. The invention 100 is adapted to protect the privacy of a patient 192 from the view of traffic 193 during an unfortunate event. The invention 100 comprises a plurality of mesh panels 101, one or more living hinges 102, and a plurality of weighted anchors 103. Each of the plurality of mesh panels 101 is a screen the blocks the view of the unfortunate event from passing traffic 193. The one or more living hinges 102 attaches an initial mesh panel selected from the plurality of mesh panels 101 to a subsequent panel selected from the plurality of mesh panels 101. The plurality of weighted anchors 103 form anchor points that anchor the interconnected plurality of mesh panels 101 to the ground 194. The invention 100 collapses into a stack 104 for storage within an emergency response vehicle.

Each of the plurality of mesh panels 101 is an opaque structure. Each of the plurality of mesh panels 101 forms a privacy screen that prevents passing traffic 193 from viewing both the patient 192 and the activities of the emergency service personnel 191. Each of the plurality of mesh panels 101 forms a disk structure. Each of the plurality of mesh panels 101 are identical. The plurality of mesh panels 101 are interconnected. The plurality of mesh panels 101 comprises a first panel 111, a second panel 112, and a third panel 113.

The first panel 111 is a first rectangular structure selected from the plurality of mesh panels 101. When erected vertically, the first panel 111 protects the patient 192 and the emergency service personnel 191 from the view of passing traffic 193. The first panel 111 comprises a first frame 141 and a first sheeting 151.

The first frame 141 is an openwork structure. The first frame 141 is a rectangular structure. The first frame 141 is formed from four shafts that form the perimeter of the rectangular structure of the first frame 141. The space within the formed perimeter of the first frame 141 is open.

The first sheeting 151 is a first mesh textile sheeting. The mesh textile is selected with a fine mesh size such that the first sheeting 151 blocks visibility through the first sheeting 151 while allowing wind to pass through the first panel 111. The first sheeting 151 mounts on the first frame 141 in a manner similar to mounting a canvas to a painter's frame.

The second panel 112 is a second rectangular structure selected from the plurality of mesh panels 101. When erected vertically, the second panel 112 protects the patient 192 and the emergency service personnel 191 from the view of passing traffic 193. The second panel 112 comprises a second frame 142 and a second sheeting 152.

The second frame 142 is an openwork structure. The second frame 142 is a rectangular structure. The second frame 142 is formed from four shafts that form the perimeter of the rectangular structure of the second frame 142. The space within the formed perimeter of the second frame 142 is open.

The second sheeting 152 is a second mesh textile sheeting. The second mesh textile is selected with a fine mesh size such that the second sheeting 152 blocks visibility through the second sheeting 152 while allowing wind to pass through the second panel 112. The second sheeting 152 mounts on the second frame 142 in a manner similar to mounting a canvas to a painter's frame.

The third panel 113 is a third rectangular structure selected from the plurality of mesh panels 101. When erected vertically, the third panel 113 protects the patient 192 and the emergency service personnel 191 from the view of passing traffic 193. The third panel 113 comprises a third frame 143 and a third sheeting 153.

The third frame 143 is an openwork structure. The third frame 143 is a rectangular structure. The third frame 143 is formed from four shafts that form the perimeter of the rectangular structure of the third frame 143. The space within the formed perimeter of the third frame 143 is open.

The third sheeting 153 is a third mesh textile sheeting. The mesh textile is selected with a fine mesh size such that the third sheeting 153 blocks visibility through the third sheeting 153 while allowing wind to pass through the third panel 113. The third sheeting 153 mounts on the third frame 143 in a manner similar to mounting a canvas to a painter's frame.

The first frame 141, the second frame 142, and the third frame 143 are identical. The first sheeting 151, the second sheeting 152, and the third sheeting 153 are identical.

Each of the one or more living hinges 102 is a flexible fastening device. Each of the one or more living hinges 102 attaches an initial mesh panel selected from the plurality of mesh panels 101 to a subsequent mesh panel selected from the plurality of mesh panels 101. Each of the one or more living hinges 102 attaches the initial mesh panel to the subsequent mesh panel such that the subsequent mesh panel rotates relative to the initial mesh panel. The rotation of any subsequent panel to rotate relative to its initial panel allows the plurality of mesh panels 101 to collapse into a stack 104 for storage.

Each of the one or more living hinges 102 is a flexure bearing often referred to as a living hinge. Each of the one or more living hinges 102 is a rectangular textile structure. The one or more living hinges 102 comprises a first living hinge 121 and a second living hinge 122.

The first living hinge 121 is a rectangular textile structure. The first living hinge 121 forms a living hinge that attaches the first panel 111 to the second panel 112. The first living hinge 121 attaches the first frame 141 of the first panel 111 to the second frame 142 of the second panel 112 such that the second panel 112 rotates relative to the first panel 111.

The second living hinge 122 is a rectangular textile structure. The second living hinge 122 forms a living hinge that attaches the second panel 112 to the third panel 113. The second living hinge 122 attaches the second frame 142 of the second panel 112 to the third frame 143 of the third panel 113 such that the third panel 113 rotates relative to the second panel 112.

Each of the plurality of weighted anchors 103 is a mechanical structure. Each of the plurality of weighted anchors 103 is a weighted structure. There is a one to one correspondence between the plurality of weighted anchors 103 and the plurality of mesh panels 101. The plurality of weighted anchors 103 receives a mesh panel selected from the plurality of mesh panels 101. Each of the plurality of weighted anchors 103 supports the mesh panel associated with the selected weighted anchor such that the faces of the selected mesh panel are vertically oriented. Each of the plurality of weighted anchors 103 is weighted such that the wind against the mesh panels will not shift the positioning of the invention 100. Each of the plurality of weighted anchors 103 further provides additional anchor points used by the emergency service personnel 191 to secure other equipment during use.

The plurality of weighted anchors 103 comprises a first weighted anchor 131, a second weighted anchor 132, and a third weighted anchor 133.

The first weighted anchor 131 is a mechanical structure selected from the plurality of weighted anchors 103. The first weighted anchor 131 has an irregular prism structure. The first weighted anchor 131 is formed from a high-density material such that wind forces against the plurality of mesh panels 101 will not shift the positioning of the invention 100. The use of one or more weighted structures to anchor an object is well-known and documented in the mechanical and transportation arts. The first weighted anchor 131 comprises a first weighted pedestal 161, a first panel clip 181, and a first plurality of auxiliary clips 171.

The first weighted pedestal 161 is an irregularly shaped prism structure. The first weighted pedestal 161 is formed as a semi-rigid structure with an elastic nature. The first weighted pedestal 161 forms the mass of the first weighted anchor 131. The first weighted pedestal 161 is a pedestal that forms the load path between the first panel 111 and the ground 194.

The first panel clip 181 is a negative space that is formed through the first weighted pedestal 161 from the first congruent end to the second congruent end of the superior end of the first weighted pedestal 161. The first panel clip 181 has a rectangular hyoid shape with the open end formed in the superior surface of the first weighted pedestal 161. The span of the distance between a first arm and a second arm of the hyoid shape of the first panel clip 181 is selected such that the faces of the disk structure of the first panel 111 will insert between the arms of the hyoid structure of the first panel clip 181.

When the first panel 111 inserts into the first panel clip 181, the first arm of the hyoid shape of the first panel clip 181 is separated from the second arm of the hyoid shape of the first panel clip 181 which creates a torque that attempts to return the first arm and the second arm to their relaxed shape. When the first panel 111 is placed between the first arm and the second arm, the semi-rigid structure of the first panel clip 181 will apply a pressure against the first panel 111 through the first arm and the second arm that effectively attaches the first panel 111 to the first weighted anchor 131.

Each of the first plurality of auxiliary clips 171 is a spring loaded clip. Each of the first plurality of auxiliary clips 171 mount on a face of the first weighted pedestal 161 selected from the group consisting of a first congruent end of the first weighted pedestal 161 and a second congruent end of the first weighted pedestal 161. Each of the first plurality of auxiliary clips 171 is accessible to the emergency service personnel 191 such that the emergency service personnel 191 can anchor equipment, such as a tarpaulin, to the first weighted pedestal 161.

The second weighted anchor 132 is a mechanical structure selected from the plurality of weighted anchors 103. The second weighted anchor 132 has an irregular prism structure. The second weighted anchor 132 is formed from a high-density material such that wind forces against the plurality of mesh panels 101 will not shift the positioning of the invention 100. The use of one or more weighted structures to anchor an object is well-known and documented in the mechanical and transportation arts. The second weighted anchor 132 comprises a second weighted pedestal 162, a second panel clip 182, and a second plurality of auxiliary clips 172.

The second weighted pedestal 162 is an irregularly shaped prism structure. The second weighted pedestal 162 is formed as a semi-rigid structure with an elastic nature. The second weighted pedestal 162 forms the mass of the second weighted anchor 132. The second weighted pedestal 162 is a pedestal that forms the load path between the second panel 112 and the ground 194.

The second panel clip 182 is a negative space that is formed through the second weighted pedestal 162 from the first congruent end to the second congruent end of the superior end of the second weighted pedestal 162. The second panel clip 182 has a rectangular hyoid shape with the open end formed in the superior surface of the second weighted pedestal 162. The span of the distance between a third arm and a fourth arm of the hyoid shape of the second panel clip 182 is selected such that the faces of the disk structure of the second panel 112 will insert between the arms of the hyoid structure of the second panel clip 182.

When the second panel 112 inserts into the second panel clip 182, the third arm of the hyoid shape of the second panel clip 182 is separated from the fourth arm of the hyoid shape of the second panel clip 182 which creates a torque that attempts to return the third arm and the fourth arm to their relaxed shape. When the second panel 112 is placed between the third arm and the fourth arm, the semi-rigid structure of the second panel clip 182 will apply a pressure against the second panel 112 through the third arm and the fourth arm that effectively attaches the second panel 112 to the second weighted anchor 132.

Each of the second plurality of auxiliary clips 172 is a spring loaded clip. Each of the second plurality of auxiliary clips 172 mount on a face of the second weighted pedestal 162 selected from the group consisting of a third congruent end of the second weighted pedestal 162 and a fourth congruent end of the second weighted pedestal 162. Each of the second plurality of auxiliary clips 172 is accessible to the emergency service personnel 191 such that the emergency service personnel 191 can anchor equipment, such as a tarpaulin, to the second weighted pedestal 162.

The third weighted anchor 133 is a mechanical structure selected from the plurality of weighted anchors 103. The third weighted anchor 133 has an irregular prism structure. The third weighted anchor 133 is formed from a high-density material such that wind forces against the plurality of mesh panels 101 will not shift the positioning of the invention 100. The use of one or more weighted structures to anchor an object is well-known and documented in the mechanical and transportation arts. The third weighted anchor 133 comprises a third weighted pedestal 163, a third panel clip 183, and a third plurality of auxiliary clips 173.

The third weighted pedestal 163 is an irregularly shaped prism structure. The third weighted pedestal 163 is formed as a semi-rigid structure with an elastic nature. The third weighted pedestal 163 forms the mass of the third weighted anchor 133. The third weighted pedestal 163 is a pedestal that forms the load path between the third panel 113 and the ground 194.

The third panel clip 183 is a negative space that is formed through the third weighted pedestal 163 from the first congruent end to the second congruent end of the superior end of the third weighted pedestal 163. The third panel clip 183 has a rectangular hyoid shape with the open end formed in the superior surface of the third weighted pedestal 163. The span of the distance between a fifth arm and a sixth arm of the hyoid shape of the third panel clip 183 is selected such that the faces of the disk structure of the third panel 113 will insert between the arms of the hyoid structure of the third panel clip 183.

When the third panel 113 inserts into the third panel clip 183, the fifth arm of the hyoid shape of the third panel clip 183 is separated from the sixth arm of the hyoid shape of the third panel clip 183 which creates a torque that attempts to return the fifth arm and the sixth arm to their relaxed shape. When the third panel 113 is placed between the fifth arm and the sixth arm, the semi-rigid structure of the third panel clip 183 will apply a pressure against the third panel 113 through the fifth arm and the sixth arm that effectively attaches the third panel 113 to the third weighted anchor 133.

Each of the third plurality of auxiliary clips 173 is a spring loaded clip. Each of the third plurality of auxiliary clips 173 mount on a face of the third weighted pedestal 163 selected from the group consisting of a fifth congruent end of the third weighted pedestal 163 and a sixth congruent end of the third weighted pedestal 163. Each of the third plurality of auxiliary clips 173 is accessible to the emergency service personnel 191 such that the emergency service personnel 191 can anchor equipment, such as a tarpaulin, to the third weighted pedestal 163.

The first weighted pedestal 161, the second weighted pedestal 162, and the third weighted pedestal 163 are identical. The first panel clip 181, the second panel clip 182, and the third panel clip 183 are identical. The first plurality of auxiliary clips 171, the second plurality of auxiliary clips 172, and the third plurality of auxiliary clips 173 are identical.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

or align within acceptable manufacturing tolerances.

Anchor: As used in this disclosure, anchor means to hold an object firmly or securely.

Anchor Point: As used in this disclosure, an anchor point is a location to which a first object can be securely attached to a second object.

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Cantilever V Spring: As used in this disclosure, a cantilever V spring is a torsion spring that is formed in a chevron, hyoid or horseshoe shape. The cantilever V spring comprises a first cantilever structure and a second cantilever structure wherein the fixed end of the first cantilever structure is attached to the fixed end of the second cantilever structure. Within this structure, when a force is applied to the cantilever V spring such that the first cantilever structure moves relative to from the second cantilever structure the force deforms the cantilever V spring in an elastic manner that: 1) resists the application of the force; and 2) stores the energy deformation such that when the force is no longer applied the cantilever V spring returns to its relaxed shape. Depending on the application, a cantilever V spring can be considered a torsion spring, a tension spring, or a compression spring.

Clip: As used in this disclosure, a clip is a fastener that attaches to an object by gripping or clasping the object. A clip is typically spring loaded.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Flexure Bearing: As used in this disclosure, a flexure bearing is a thin and flexible material that is used to attach, or bind, a first object to a second object such that the first object can rotate in a controlled direction relative to the second object.

Fluid: As used in this disclosure, a fluid refers to a state of matter wherein the matter is capable of flow and takes the shape of a container it is placed within. The term fluid commonly refers to a liquid or a gas.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Frame: As used in this disclosure, a frame is a structure: a) to which an object attaches; and, b) which forms a portion of the load path of the object.

Gas: As used in this disclosure, a gas refers to a state (phase) of matter that is fluid and that fills the volume of the structure that contains it. Stated differently, the volume of a gas always equals the volume of its container.

Ground: As used in this disclosure, the ground is a solid supporting surface formed by the Earth. The term level ground means that the supporting surface formed by the ground is roughly perpendicular to the force of gravity.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Living Hinge: As used in this disclosure, refers to a single object that is formed out of elastomeric material that is divided into a first segment, a second segment, and the living hinge. The elastic nature of the elastomeric material allow the living hinge to be flexed in the manner of a hinge allowing the first segment to rotate relative to the second hinge. A living hinge is a form of a flexure bearing. A material that is formed with a series of parallel living hinges is referred to as a kerf bending. A kerf bending formed in a plate allows the plate to be bent into a curved shape.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Opaque: As used in this disclosure, opaque refers to an object or material that prevents the passage of radiation through the object or material.

Openwork: As used in this disclosure, the term open work is used to describe a structure, often a surface, which is formed with openings that allow for visibility and fluid flow through the structure. Wrought work and meshes are forms of openwork.

Patient: As used in this disclosure, a patient is a person who is designated to receive a medical treatment, therapy or service. The term patient may be extended to an animal when used within the context of the animal receiving veterinary treatment or services Pedestal: As used in this disclosure, a pedestal is an intermediary load bearing structure that that transfers a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sheeting: As used in this disclosure, a sheeting is a material, such as a paper, textile, a plastic, or a metal foil, in the form of a thin flexible layer or layers.

Slot: As used in this disclosure, a slot is a long narrow channel or aperture that is formed in or through an object.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stack: As used in this disclosure, a stack refers to a collection of disk-shaped objects that are stored such that the centers of each of the disk-shaped objects are aligned.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Tarpaulin: As used in this disclosure, a tarpaulin is a protective covering made of a sheeting. The sheeting can be a textile material made from made from fibers or yarns suitable for textile production methods including, but not limited to, weaving, knitting or felting. The sheeting can also be made of a material in the form of a continuous film including, but not limited to, plastic films.

Textile: As used in this disclosure, a textile is a material that is woven, knitted, braided or felted. Synonyms in common usage for this definition include fabric and cloth.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Unfortunate Event: As used in this disclosure, an unfortunate event is an incident that: 1) happens unexpectedly; 2) happens unintentionally; and, 3) has the potential to cause injury and or property damage.

Vehicle: As used in this disclosure, a vehicle is a motorized device used for transporting passengers, goods, or equipment. The term motorized vehicle refers to a vehicle can move under power provided by an electric motor or an internal combustion engine.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable screen comprising:

a plurality of mesh panels, one or more living hinges, and a plurality of weighted anchors;

wherein each of the one or more living hinges attaches an initial mesh panel selected from the plurality of mesh panels to a subsequent panel selected from the plurality of mesh panels;

wherein the plurality of weighted anchors form anchor points that anchor the interconnected plurality of mesh panels to a supporting surface known as the ground;

wherein the portable screen is a privacy screen;

wherein the portable screen is adapted for use with emergency service personnel;

wherein the portable screen is adapted to protect the privacy of a patient from the view of traffic during an unfortunate event;

wherein each of the plurality of mesh panels is a screen that blocks the view of the unfortunate event from passing traffic;

wherein the plurality of weighted anchors comprises a first weighted anchor, a second weighted anchor, and a third weighted anchor;

wherein the first weighted anchor comprises a first weighted pedestal, a first panel clip, and a first plurality of auxiliary clips;

wherein the second weighted anchor comprises a second weighted pedestal, a second panel clip, and a second plurality of auxiliary clips;

wherein the third weighted anchor comprises a third weighted pedestal, a third panel clip, and a third plurality of auxiliary clips;

wherein the first panel clip is formed in the first weighted pedestal;

wherein the second panel clip is formed in the second weighted pedestal;

wherein the third panel clip is formed in the third weighted pedestal;

wherein the first plurality of auxiliary clips attaches to the first weighted pedestal;

wherein the second plurality of auxiliary clips attaches to the second weighted pedestal;

wherein the third plurality of auxiliary clips attaches to the third weighted pedestal.

2. The portable screen according to claim 1 wherein the portable screen collapses into a stack for storage within an emergency response vehicle.

3. The portable screen according to claim 2 wherein each of the plurality of mesh panels is an opaque structure;

wherein each of the plurality of mesh panels forms a privacy screen that prevents passing traffic from viewing the activities of the emergency service personnel;

wherein each of the plurality of mesh panels forms a privacy screen that prevents passing traffic from viewing the patient.

4. The portable screen according to claim 3 wherein each of the one or more living hinges is a flexible fastening device;

wherein each of the one or more living hinges attaches an initial mesh panel selected from the plurality of mesh panels to a subsequent mesh panel selected from the plurality of mesh panels;

wherein each of the one or more living hinges attaches the initial mesh panel to the subsequent mesh panel such that the subsequent mesh panel rotates relative to the initial mesh panel.

5. The portable screen according to claim 4 wherein each of the plurality of weighted anchors is a mechanical structure;

wherein each of the plurality of weighted anchors is a weighted structure;

wherein there is a one to one correspondence between the plurality of weighted anchors and the plurality of mesh panels;

wherein the plurality of weighted anchors receives a mesh panel selected from the plurality of mesh panels;

wherein each of the plurality of weighted anchors is weighted such that the wind against the mesh panels will not shift the positioning of the portable screen;

wherein each of the plurality of weighted anchors further provides additional anchor points for use by the emergency service personnel.

6. The portable screen according to claim 5 wherein each of the plurality of mesh panels forms a disk structure;

wherein each of the plurality of mesh panels is identical;

wherein the plurality of mesh panels are interconnected.

7. The portable screen according to claim 6 wherein each of the one or more living hinges is a flexure bearing;

wherein each of the one or more living hinges is a rectangular textile structure.

8. The portable screen according to claim 7 wherein each of the plurality of weighted anchors supports the mesh panel associated with the selected weighted anchor such that the faces of the selected mesh panel are vertically oriented.

9. The portable screen according to claim 8 wherein the plurality of mesh panels comprises a first panel, a second panel, and a third panel;

wherein the first panel is a first rectangular structure selected from the plurality of mesh panels;

wherein the second panel is a second rectangular structure selected from the plurality of mesh panels;

wherein the third panel is a third rectangular structure selected from the plurality of mesh panels;

wherein the first panel protects the patient and the emergency service personnel from the view of passing traffic;

wherein the second panel protects the patient and the emergency service personnel from the view of passing traffic;

wherein the third panel protects the patient and the emergency service personnel from the view of passing traffic.

10. The portable screen according to claim 9 wherein the one or more living hinges comprises a first living hinge and a second living hinge;

wherein the first living hinge is a rectangular textile structure;

wherein the second living hinge is a rectangular textile structure;

wherein the first living hinge forms a living hinge that attaches the first panel to the second panel;

wherein the second living hinge forms a living hinge that attaches the second panel to the third panel;

wherein the first living hinge attaches the first frame of the first panel to the second frame of the second panel such that the second panel rotates relative to the first panel;

wherein the second living hinge attaches the second frame of the second panel to the third frame of the third panel such that the third panel rotates relative to the second panel.

11. The portable screen according to claim 10 wherein the first weighted anchor is a mechanical structure selected from the plurality of weighted anchors;

wherein the second weighted anchor is a mechanical structure selected from the plurality of weighted anchors;

wherein the third weighted anchor is a mechanical structure selected from the plurality of weighted anchors;

wherein the first weighted anchor has an irregular prism structure;

wherein the second weighted anchor has an irregular prism structure;

wherein the third weighted anchor has an irregular prism structure;

wherein the first weighted anchor is formed from a high-density material such that wind forces against the plurality of mesh panels will not shift the positioning of the portable screen;

wherein the second weighted anchor is formed from a high-density material such that wind forces against the plurality of mesh panels will not shift the positioning of the portable screen;

wherein the third weighted anchor is formed from a high-density material such that wind forces against the plurality of mesh panels will not shift the positioning of the portable screen.

12. The portable screen according to claim 11 wherein the first panel comprises a first frame and a first sheeting;

wherein the first sheeting attaches to the first frame;

wherein the second panel comprises a second frame and a second sheeting;

wherein the second sheeting attaches to the second frame;

wherein the third panel comprises a third frame and a third sheeting;

wherein the third sheeting attaches to the third frame.

13. The portable screen according to claim 12 wherein the first frame is an openwork structure;

wherein the first frame is a rectangular structure;

wherein the first frame is formed from four shafts that form the perimeter of the rectangular structure of the first frame;

wherein the space within the formed perimeter of the first frame is open;

wherein the second frame is an openwork structure;

wherein the second frame is a rectangular structure;

wherein the second frame is formed from four shafts that form the perimeter of the rectangular structure of the second frame;

wherein the space within the formed perimeter of the second frame is open;

wherein the third frame is an openwork structure;

wherein the third frame is a rectangular structure;

wherein the third frame is formed from four shafts that form the perimeter of the rectangular structure of the third frame;

wherein the space within the formed perimeter of the third frame is open.

14. The portable screen according to claim 13 wherein the first sheeting is a first mesh textile sheeting;

wherein the second sheeting is a second mesh textile sheeting;

wherein the third sheeting is a third mesh textile sheeting;

wherein the mesh textile is selected with a fine mesh size such that the first sheeting blocks visibility through the first sheeting while allowing wind to pass through the first panel;

wherein the mesh textile is selected with a fine mesh size such that the second sheeting blocks visibility through the second sheeting while allowing wind to pass through the second panel;

wherein the mesh textile is selected with a fine mesh size such that the third sheeting blocks visibility through the third sheeting while allowing wind to pass through the third panel.

15. The portable screen according to claim 14 wherein the first frame, the second frame, and the third frame are identical;

wherein the first sheeting, the second sheeting, and the third sheeting are identical.

16. The portable screen according to claim 15 wherein the first weighted pedestal is an irregularly shaped prism structure;

wherein the second weighted pedestal is an irregularly shaped prism structure;

wherein the third weighted pedestal is an irregularly shaped prism structure;

wherein the first weighted pedestal is formed as a semi-rigid structure with an elastic nature;

wherein the second weighted pedestal is formed as a semi-rigid structure with an elastic nature;

wherein the third weighted pedestal is formed as a semi-rigid structure with an elastic nature;

wherein the first weighted pedestal forms the mass of the first weighted anchor;

wherein the second weighted pedestal forms the mass of the second weighted anchor;

wherein the third weighted pedestal forms the mass of the third weighted anchor;

wherein the first weighted pedestal is a pedestal that forms the load path between the first panel and the ground;

wherein the second weighted pedestal is a pedestal that forms the load path between the second panel and the ground;

wherein the third weighted pedestal is a pedestal that forms the load path between the third panel and the ground.

17. The portable screen according to claim 16 wherein the first panel clip is a negative space that is formed through the first weighted pedestal from the first congruent end to the second congruent end of the superior end of the first weighted pedestal;

wherein the second panel clip is a negative space that is formed through the second weighted pedestal from the third congruent end to the fourth congruent end of the superior end of the second weighted pedestal;

wherein the third panel clip is a negative space that is formed through the third weighted pedestal from the fifth congruent end to the sixth congruent end of the superior end of the third weighted pedestal;

wherein the first panel clip has a rectangular hyoid shape with the open end formed in the superior surface of the first weighted pedestal;

wherein the second panel clip has a rectangular hyoid shape with the open end formed in the superior surface of the second weighted pedestal;

wherein the third panel clip has a rectangular hyoid shape with the open end formed in the superior surface of the third weighted pedestal;

wherein the span of the distance between a first arm and a second arm of the hyoid shape of the first panel clip is selected such that the faces of the disk structure of the first panel inserts between the arms of the hyoid structure of the first panel clip;

wherein the span of the distance between a third arm and a fourth arm of the hyoid shape of the second panel clip is selected such that the faces of the disk structure of the second panel will insert between the arms of the hyoid structure of the second panel clip;

wherein the span of the distance between a fifth arm and a sixth arm of the hyoid shape of the third panel clip is selected such that the faces of the disk structure of the third panel will insert between the arms of the hyoid structure of the third panel clip.

18. The portable screen according to claim 17 wherein each of the first plurality of auxiliary clips is a spring loaded clip;

wherein each of the second plurality of auxiliary clips is a spring loaded clip;

wherein each of the third plurality of auxiliary clips is a spring loaded clip;

wherein each of the first plurality of auxiliary clips mounts on a face of the first weighted pedestal selected from the group consisting of a first congruent end of the first weighted pedestal and a second congruent end of the first weighted pedestal;

wherein each of the second plurality of auxiliary clips mounts on a face of the second weighted pedestal selected from the group consisting of a third congruent end of the second weighted pedestal and a fourth congruent end of the second weighted pedestal;

wherein each of the third plurality of auxiliary clips mount on a face of the third weighted pedestal selected from the group consisting of a fifth congruent end of the third weighted pedestal and a sixth congruent end of the third weighted pedestal.

19. The portable screen according to claim 18 wherein the first weighted pedestal, the second weighted pedestal, and the third weighted pedestal are identical;

wherein the first panel clip, the second panel clip, and the third panel clip are identical;

wherein the first plurality of auxiliary clips, the second plurality of auxiliary clips, and the third plurality of auxiliary clips are identical.

* * * * *